US008665569B2

(12) United States Patent
Heerdt et al.

(10) Patent No.: US 8,665,569 B2
(45) **Date of Patent: *Mar. 4, 2014**

(54) ARC EXTINGUISHING SWITCH AND SWITCHING METHOD THEREOF

(75) Inventors: Frank Heerdt, Shenzhen (CN); Zhixian Wu, Shenzhen (CN)

(73) Assignee: ASCO Power Technologies, L.P., Florham Park, NJ (US)

( * ) Notice: Subject to any disclaimer, the term of this patent is extended or adjusted under 35 U.S.C. 154(b) by 224 days.

This patent is subject to a terminal disclaimer.

(21) Appl. No.: 13/051,641

(22) Filed: Mar. 18, 2011

(65) Prior Publication Data

US 2012/0125894 A1 May 24, 2012

(30) Foreign Application Priority Data

Nov. 18, 2010 (CN) ..... 2010 1 0549330

(51) Int. Cl.
*H01H 33/16* (2006.01)

(52) U.S. Cl.
USPC ..... 361/2

(58) Field of Classification Search
USPC ..... 361/2
See application file for complete search history.

(56) References Cited

U.S. PATENT DOCUMENTS 5,854,729 A * 12/1998 Degeneff et al. ..... 361/4
6,051,893 A * 4/2000 Yamamoto et al. ..... 307/43
2011/0292551 A1 12/2011 Zheng et al.

FOREIGN PATENT DOCUMENTS

CN 101854075 A 10/2010

OTHER PUBLICATIONS

First Chinese Office Action regarding Application No. 201010549330.8, dated Apr. 15, 2013. Translation provided by Unitalen Attorneys at Law.
Second Chinese Office Action regarding Application No. 201010549330.8, dated Oct. 18, 2013. Partial translation provided by Unitalen Attorneys at Law.

* cited by examiner

*Primary Examiner* — Jared Fureman
*Assistant Examiner* — Kevin J Comber
(74) *Attorney, Agent, or Firm* — Harness, Dickey & Pierce, P.L.C.

(57) ABSTRACT

The present invention discloses an arc extinguishing switch, including a mechanical switch and a first electric branch connected in parallel with a first contact branch of the mechanical switch, the first electric branch includes a first controllable unidirectional turn-on subbranch and a second controllable unidirectional turn-on subbranch, the first controllable unidirectional turn-on subbranch and the second controllable unidirectional turn-on subbranch are respectively controlled by two thyristors to be turned on in AC positive and negative periods correspondingly and share a first capacitor connected in series with the two thyristors. The invention further discloses a switching method using the arc extinguishing switch. In the invention, the high power requirement for the thyristor in the arc extinguishing switch and the product cost are lowered, and it is avoided that the mechanical switch is bypassed when the short-circuit failure occurs on the thyristor.

8 Claims, 2 Drawing Sheets

ARC EXTINGUISHING SWITCH AND SWITCHING METHOD THEREOF

FIELD OF THE INVENTION

The present invention relates to power electronic devices, and in particular, to an arc extinguishing switch and a switching method thereof.

BACKGROUND OF THE INVENTION

Automatic Transfer Switch (ATS) is an electric device that switches one or more load circuits from a power supply to another power supply, and is widely used in various situations. Because the main switching component of the ATS is a mechanical switch, the switching speed is slow (about 20 ms) and it is easy to cause an arc. The arc may cause a high temperature, ignite and vaporize the metal contact of the mechanical switch, and thus greatly reduce the life time of the switch.

Static Transfer Switch (STS) is an electric device that switches one or more load circuits from one power supply to another power supply, and is used in various situations having high requirements for switching speed. The main switch component of STS is a thyristor. Although the switching speed of thyristor (less than 3 ms) is greatly increased over ATS, due to the fact that the thyristor is a semiconductor rather than a conductor, the thyristor has a turn-on voltage drop that is much higher than that of a mechanical switch made of conductor. Thus, the turn-on loss is increased. Moreover, the cost of high-power thyristor is high, and the product cost is also greatly increased. The STS is even more expensive than an uninterruptable power supply (UPS) with the same capacity.

For a long time, it is an urgent requirement that a switch has a low turn-on loss, a fast switching speed, a long life time, a good protection for load during failure and a low price.

Part of the above requirements may be satisfied by simply connecting a thyristor and a mechanical switch in parallel, but this is only applicable for situations with low power. For example, when the current in the application is 1 kA or higher, the product cost becomes very high due to the high power requirement for the thyristor. Meanwhile, when a short-circuit failure occurs on the thyristor, the power supply directly supplies power to a load via the thyristor branch, and the mechanical switch is bypassed. Thus, a threat is caused for the load. A patent in which a thyristor and a mechanical switch are simply connected in parallel as described above is filed with USPTO as early as in 1984, however, no corresponding product can be found today though about 20 years past. Thus, the deficiency and shortcoming of the patent may be reflected.

SUMMARY OF THE INVENTION

Considering the deficiency of the prior art, an object of the present invention is to provide an arc extinguishing switch and a switching method so as to lower the high power requirement for the thyristor and product cost and avoid the bypassing of the mechanical switch when the short-circuit failure occurs on the thyristor.

To attain the above object, the invention employs the following technical solutions.

An arc extinguishing switch, including a mechanical switch and a first electric branch connected in parallel with a first contact branch of the mechanical switch, the first electric branch includes a first controllable unidirectional turn-on subbranch and a second controllable unidirectional turn-on subbranch, the first controllable unidirectional turn-on subbranch and the second controllable unidirectional turn-on subbranch are respectively controlled by two thyristors to be turned on in AC positive and negative periods correspondingly and share a first capacitor connected in series with the two thyristors.

Preferably, the first controllable unidirectional turn-on subbranch includes a first thyristor, a second diode and the first capacitor, the second controllable unidirectional turn-on subbranch includes a second thyristor, a first diode and the first capacitor, the cathode of the first thyristor and the anode of the first diode are connected to one end of the first contact branch, the cathode of the second thyristor and the anode of the second diode are connected to the other end of the first contact branch, the cathodes of the first diode and the second diode are connected to one end of the first capacitor, and the anodes of the first thyristor and the second thyristor are connected to the other end of the first capacitor.

Preferably, the first controllable unidirectional turn-on subbranch includes a first thyristor, a second diode and the first capacitor, the second controllable unidirectional turn-on subbranch includes a second thyristor, a first diode and the first capacitor, the anode of the first thyristor and the cathode of the first diode are connected to one end of the first contact branch, the anode of the second thyristor and the cathode of the second diode are connected to the other end of the first contact branch, the cathodes of the first thyristor and the second thyristor are connected to one end of the first capacitor, and the anodes of the first diode and the second diode are connected to the other end of the first capacitor.

Preferably, the first controllable unidirectional turn-on subbranch includes a first thyristor, a second diode and the first capacitor, the second controllable unidirectional turn-on subbranch includes a second thyristor, a first diode and the first capacitor, the anode of the first diode and the cathode of the second diode are connected to one end of the first contact branch, the anode of the first thyristor and the cathode of the second thyristor are connected to the other end of the first contact branch, the cathodes of first diode and the first thyristor are connected to one end of the first capacitor, and the anodes of the second diode and the second thyristor are connected to the other end of the first capacitor.

Preferably, the arc extinguishing switch further includes a discharge circuit connected in parallel with the first capacitor.

Preferably, the arc extinguishing switch further includes a second electric branch connected in parallel with the second contact branch of the mechanical switch, the second electric branch includes a third controllable unidirectional turn-on subbranch and a fourth controllable unidirectional turn-on subbranch, the third controllable unidirectional turn-on subbranch and the fourth controllable unidirectional turn-on subbranch are respectively controlled by another two thyristors to be turned on in AC positive and negative periods correspondingly, and share a second capacitor connected in series with the another two thyristors.

Preferably, the arc extinguishing switch further includes a discharge circuit connected in parallel with the second capacitor.

A switching method using the arc extinguishing switch, including:

a. issuing, by a system controller, a switching signal;

b. triggering the thyristor of the first controllable unidirectional turn-on subbranch or the thyristor of the second controllable unidirectional turn-on subbranch to be turned on according to the current direction;

c. making the mechanical switch depart from the first contact, and supplying power to a load by a current flowing through the first electric branch; and d. stopping triggering the thyristor of the first electric branch when detecting that the mechanical switch departs from the first contact and reaches a safe distance that is unable to cause an arc.

Preferably, the switching method further includes the following step after step d: discharging the first capacitor.

Preferably, the switching method further includes the following steps after step d:

e. after detecting that no current passes through the first electric branch, triggering the thyristor of the third controllable unidirectional turn-on subbranch or the thyristor of the fourth controllable unidirectional turn-on subbranch to be turned on according to the current direction, and supplying power to the load by a current flowing through the second electric branch; and f. stopping triggering the thyristor of the second electric branch after detecting that the mechanical switch reaches the second contact.

The invention has the following beneficial technical effects.

According to the invention, the first electric branch connected in parallel with the first contact branch of the mechanical switch includes a first controllable unidirectional turn-on subbranch and a second controllable unidirectional turn-on subbranch, the first controllable unidirectional turn-on subbranch and the second controllable unidirectional turn-on subbranch are respectively controlled by two thyristors to be turned on in AC positive and negative periods correspondingly and share a first capacitor connected in series with the two thyristors. Firstly, because the thyristor has a property of automatic turn-off at current zero-crossing and high speed during switching, the non-contact and non-arc turn-off are realized. The impact on the circuit main switch, i.e., mechanical switch, is alleviated by using thyristors in the first and second controllable unidirectional turn-on subbranches and the arc occurring during mechanical switching is eliminated. Thus, the mechanical switch contact will not be ignited and vaporized by the high temperature of the arc, so that the life time of the mechanical switch is greatly prolonged. Moreover, the power dump time of the load caused by the slow speed of the mechanical switch is also reduced due to the rapid response of the thyristor relative to the mechanical switch. Secondly, the existence of the first capacitor may lower the power of the thyristor, so that a low-power thyristor may be used. Thus, the cost of thyristor may be lowered greatly. Moreover, when a short-circuit failure occurs on the thyristor, the thyristor is replaced by the first capacitor for implementing the arc extinguishing and the load current is lowered greatly. Therefore, the influence of thyristor failure on the load is reduced. Additionally, if a failure occurs on the first capacitor, the mechanical switch operates and thus no influence is laid on the load. Thirdly, bidirectional flow of current is realized via the combination of a thyristor, a diode and a capacitor and thus the volume of the capacitor is reduced, so that device cost is lowered. For example, it is realized that the currents in two controllable unidirectional turn-on subbranches both flow from the same end of the first capacitor, and no reverse current exists for the capacitor, thus a low-cost polar capacitor may be employed.

Furthermore, by arranging a second electric branch similar to the first electric branch to be connected in parallel with the second contact branch of the mechanical switch, non-arc cut-in from a normal power supply to an emergency power supply is realized by the mechanical switch, and non-arc cut-in from an emergency power supply to a normal power supply is also be realized by the mechanical switch, so that non-arc switching of the mechanical switch is realized.

The characteristics and advantages of the invention will be explained in detail with reference to the embodiments of the invention in conjunction with the drawings.

DETAILED DESCRIPTION OF THE EMBODIMENTS

In one embodiment, an arc extinguishing switch includes a mechanical switch S, and a first electric branch connected in parallel with the first contact branch P1 of the mechanical switch. The first electric branch includes a first controllable unidirectional turn-on subbranch and a second controllable unidirectional turn-on subbranch. The first controllable unidirectional turn-on subbranch and the second controllable unidirectional turn-on subbranch are respectively controlled by two thyristors so as to be turned on in AC positive and negative periods correspondingly, and share a first capacitor connected in series with the two thyristors.

Figure 1:
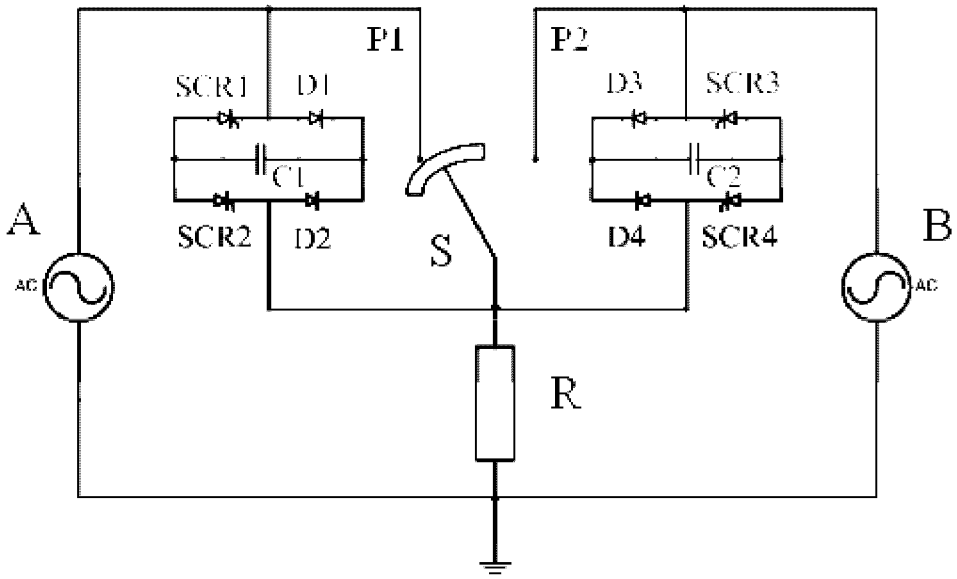
FIG. 1 is a circuit diagram of an arc extinguishing switch according to one embodiment of the invention.
Figure 2:
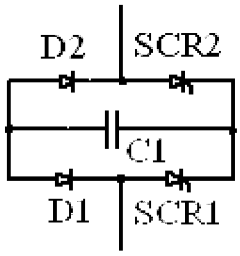
FIG. 2 is another topological graph of the first electric branch in the arc extinguishing switch.
Figure 3:
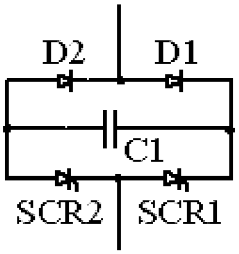
FIG. 3 is a further topological graph of the first electric branch in the arc extinguishing switch.

Referring to FIG. 1 to FIG. 3, the first electric branch includes a first thyristor SCR1, a second thyristor SCR2, a first capacitor C1, a first diode D1 and a second diode D2. The first thyristor SCR1, the second thyristor SCR2, the first diode D1 and the second diode D2 are connected to form two controllable unidirectional turn-on subbranches that are reverse to each other. The first capacitor C1 exists on the two controllable unidirectional turn-on subbranches and is connected in series with a thyristor and a diode in the corresponding unidirectional turn-on subbranch, that is, the first controllable unidirectional turn-on subbranch includes the first thyristor SCR1, the second diode D2 and the first capacitor C1 and the second controllable unidirectional turn-on subbranch includes the second thyristor SCR2, the first diode D1 and the first capacitor C1. Two subbranches of the first electric branch operate in AC positive and negative periods respectively.

In an ATS application shown in FIG. 1, the first contact branch P1 of the mechanical switch is coupled to a normal power supply A, the second contact branch P2 of the mechanical switch is coupled to an emergency power supply B, and the normal power supply A, the emergency power supply B and a load R are connected to a common ground end. The mechanical switch may switch between the first contact and the second contact so as to selectively supply power to the load R by the normal power supply A or the emergency power supply B.

Referring to FIG. 1, in a more preferable embodiment, the arc extinguishing switch further includes a second electric branch connected in parallel with the second contact branch P2 of the mechanical switch. The second electric branch includes a third thyristor SCR3, a fourth thyristor SCR4, a second capacitor C2, a third diode D3 and a fourth diode D4. The third thyristor SCR3, the fourth thyristor SCR4, the third diode D3 and the fourth diode D4 are also connected to form two controllable unidirectional turn-on subbranches that are reverse to each other. The second capacitor C2 exists on the two controllable unidirectional turn-on subbranches at the same time and is connected in series with a thyristor and a diode in the corresponding unidirectional turn-on subbranch, that is, the two subbranches respectively includes: the third thyristor SCR3, the fourth diode D4 and the second capacitor C2; the fourth thyristor SCR4, the third diode D3 and the second capacitor C2.

Referring to FIG. 1, a circuit topology of the first electric branch is as follows: the cathode of the first thyristor SCR1 and the anode of the first diode D1 are connected to one end of the first contact branch P1, the cathode of the second thyristor SCR2 and the anode of the second diode D2 are connected to the other end of the first contact branch, and the cathodes of the first diode D1 and the second diode D2 are connected to one end of the first capacitor C1, and the anodes of the first thyristor SCR1 and the second thyristor SCR2 are connected to the other end of the first capacitor C1. A circuit topology of the second electric branch is as follows: the cathode of the third thyristor SCR3 and the anode of the third diode D3 are connected to one end of second contact branch P2, the cathode of the fourth thyristor SCR4 and the anode of the fourth diode D4 are connected to the other end of the second contact branch, the cathodes of the third diode D3 and the fourth diode D4 are connected to one end of the second capacitor C2, and the anodes of the third thyristor SCR3 and the fourth thyristor SCR4 are connected to the other end of the second capacitor C2.

In the embodiment shown in FIG. 1, the normal power supply A and the emergency power supply B both employ alternating current. Under normal conditions, the first contact branch P1 of the mechanical switch S is in closed state, the normal power supply A supplies power to the load R via the mechanical switch S, and the first and the second thyristors SCR1, SCR2 in the first electric branch connected in parallel with the first contact branch P1 are in cut-off state.

When a failure occurs in the normal power supply A and it is required to switch to emergency power supply B, the system issues a switching signal. By determining the normal power supply A is in positive direction or negative direction, a controller (not shown) issues a trigger impulse. After the thyristor in the corresponding unidirectional turn-on subbranch is turned on, the mechanical switch S begins to act i.e. departs from the first contact of the mechanical switch and moves to the second contact of the mechanical switch. Thus, the non-arc cut-off of the mechanical switch S is realized in this stage.

As shown in FIG. 1, when the normal power supply A is positive in the upper and negative in the lower ("upper" and "lower" are defined by referring to the drawing), the second thyristor SCR2 is triggered to be turned on, and the current pass through the first diode D1, the first capacitor C1 and the second thyristor SCR2 in turn to supply power to the load R. When the normal power supply A is negative in the upper and positive in the lower, the first thyristor SCR1 is triggered to be in turned on, and the current pass through the second diode D2, the first capacitor C1 and the first thyristor SCR1 in turn to supply power to the load R.

When the thyristor receives a trigger signal while the mechanical switch does not depart from the first contact, because the impedance of the mechanical switch is small and the impedance of the thyristor, the diode and the capacitor is large, all of the current passes through the mechanical switch, and thus the voltage drop and the turn-on loss are both almost zero. During the process in which the mechanical switch departs from the first contact, the energy of the arc generated is absorbed by the capacitor. After a detection device (not shown) detects that the mechanical switch departs from the first contact of the mechanical switch and reaches a safe distance that is unable to cause an arc, it is stopped to send the trigger signal to the first thyristor SCR1 or the second thyristor SCR2. The first thyristor SCR1 or the second thyristor SCR2 is turned off automatically when the current crosses zero point, so that the non-arc static turn-off of the mechanical switch is realized.

When the detection device detects that no current passes through the first thyristor SCR1 or the second thyristor SCR2, the third thyristor SCR3 or fourth thyristor SCR4 is triggered to be turned on, and the emergency power supply B supplies power to the load via the second electric branch. Preferably, a certain dead zone time is set between the trigger signals of the first and the second electric branches, thus the situation in which the normal power supply and the emergency power supply in parallel supply power at the same time may be avoided. Only after the mechanical switch reaches the second contact, the current passes through the mechanical switch with lower impedance. Finally, it is stopped to send the trigger signal to the third thyristor SCR3 or the fourth thyristor SCR4. Thus, the non-arc entry of the emergency power supply is realized.

Whether to trigger the third thyristor SCR3 or the fourth thyristor SCR4 is determined according to the positive or negative of the voltage of the emergency power supply B. As shown in FIG. 1, when the emergency power supply B is positive in the upper and negative in the lower, the fourth thyristor SCR4 is triggered to be turned-on, and the current passes through the third diode D3, the second capacitor C2 and the fourth thyristor SCR4 so as to supply power to load R. When the emergency power supply B is negative in the upper and positive in the lower, the third thyristor SCR3 is triggered to be turned-on, and the current passes through the fourth diode D4, the second capacitor C2 and the third thyristor SCR3 so as to supply power to the load R.

Because the energy of the arc generated is to be absorbed by the first capacitor and the second capacitor, the capacity of the first capacitor and the second capacitor are designed according to the energy generated by the arc. There are two conditions in connection with the generation of arc: 1) the voltage between two contacts, when the voltage U is greater than 10 V to 20 V and the current is greater than 80 mA to 100 mA, an arc is generated; 2) the distance d between two contacts, when the electric field strength E=U/d between two contacts is greater than 300 V/m, an arc is generated. Therefore, the rated voltage of a capacitor for absorbing the arc energy may be selected according to the arc generation condition (a voltage larger than 20 V), the capacity of the capacitor may be calculated according to the rated current of the switch and a current several times higher than standard short current may be considered. The longest charging time of the capacitor is half of the power supply period, because the thyristor is turned off automatically when the current crosses zero point.

Referring to FIG. 2, the first electric branch may also employ another circuit topology, in which the anode of the first thyristor SCR1 and the cathode of the first diode D1 are connected to one end of the first contact branch, the anode of the second thyristor SCR2 and the cathode of the second diode D2 are connected to the other end of the first contact branch, the cathodes of the first thyristor SCR1 and the second thyristor SCR2 are connected to one end of the first capacitor C1, and the anodes of the first diode D1 and the second diode D2 are connected to the other end of the first capacitor.

Referring to FIG. 3, the first electric branch may also employ another circuit topology, in which the anode of the first diode D1 and the cathode of the second diode D2 are connected to one end of the first contact branch, the anode of the first thyristor SCR1 and the cathode of the second thyristor SCR2 are connected to the other end of the first contact branch, the cathodes of the first diode D1 and the first thyristor SCR1 are connected to one end of the first capacitor C1, and the anodes of the second diode D2 and the second thyristor SCR2 are connected to the other end of the first capacitor C1.

Also, in addition to the topology as shown in FIG. 1, the second electric branch may employ the topology similar to that of the first electric branch, as shown in FIG. 2 and FIG. 3.

Figure 4:
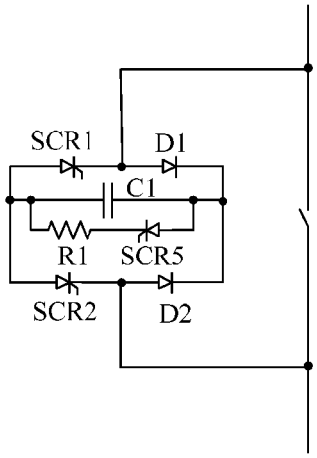
FIG. 4 is a circuit diagram of the first electric branch with the discharge circuit.
Figure 5:
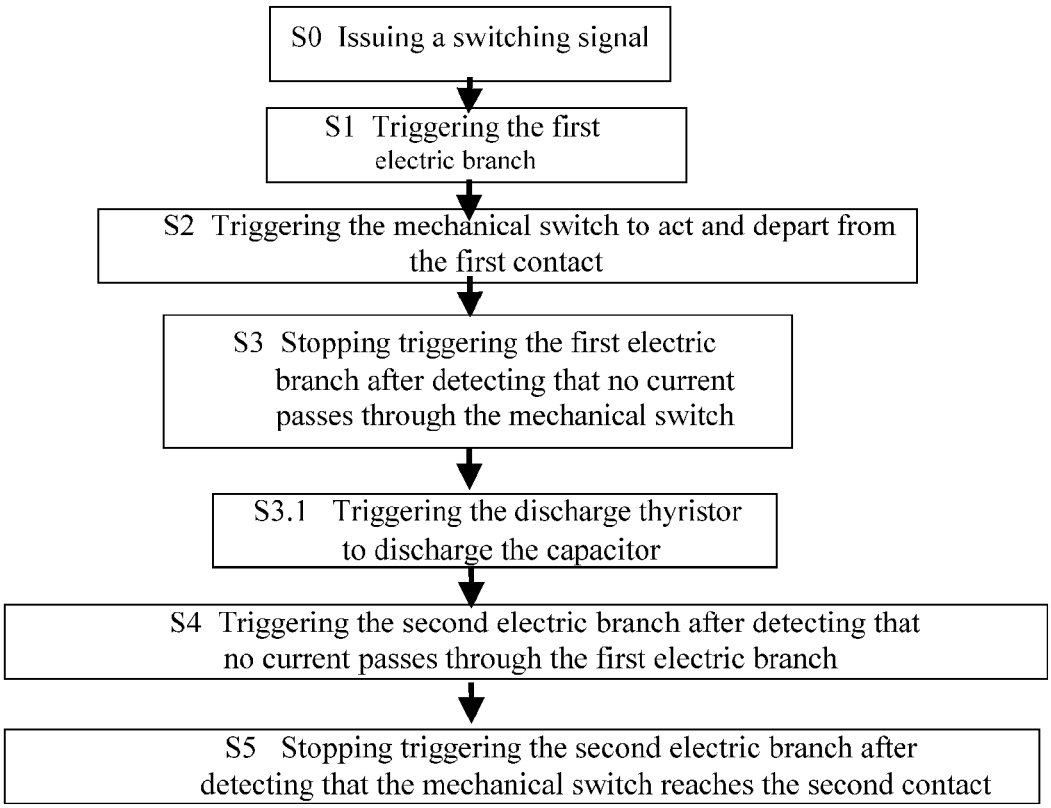
FIG. 5 is a flow chart of a switching method according to one embodiment of the invention.

As shown in FIG. 4, in a more preferable embodiment, a discharge circuit is connected in parallel with the first capacitor C1. The discharge circuit preferably includes a discharge resistor R1 and a discharge thyristor SCR5 connected in series. The discharge circuit may discharge the first capacitor C1 and eliminate the residue energy stored in the first capacitor C1. Thus, it is avoided that the residue energy in the capacitor causes an impact on the circuit when the mechanical switch is switched for the next time. Also, for the second electric branch, a similar discharge circuit may be arranged for the second capacitor C2, and discharge thyristors are triggered to discharge the first and the second capacitors C1, C2 correspondingly during the time interval between the switching processes.

Furthermore, a thyristor buffer circuit (not shown) may be connected in parallel with each thyristor respectively. For example, the thyristor buffer circuit may be consisted of a capacitor and a resistor connected in series, for absorbing the electric impulse generated. The thyristor buffer circuit may employ a common RCD design to protect the thyristor from the impact of the impulse current or impulse voltage and to prolong the life time of the thyristor.

The invention further provides a switching method of the above arc extinguishing switch. The process of the method according to one embodiment of the invention is as shown in FIG. 4 and includes the following steps.

Under normal conditions, the mechanical switch S is in the first contact, and the first electric branch is also be in cut-off state. Because the impedance of the mechanical switch is small and the impedance of the thyristor, the diode and the capacitor is large, all of the current passes through the mechanical switch, and thus the voltage drop and the turn-on loss both are almost zero.

In step S0, when a failure occurs on the normal power supply A and it is required to switch to the emergency power supply B, the system issues a switching signal. Next, in step S1, the first thyristor SCR1 or the second thyristor SCR2 is triggered to be turned on according to the current direction. Then, in step S2, the mechanical switch begins to act, i.e. departs from the first contact and moves to the second contact; and meanwhile, the current continues to supply power to the load R via the first electric branch.

Because the first electric branch has a first capacitor C1 with a large impedance, the current passing through the first electric branch may be lowered greatly, thus the first thyristor SCR1 and the second thyristor SCR2 may be a low-power thyristor.

In step S3, after it is detected that the mechanical switch departs from the first contact and reaches a safe distance that is unable to cause an arc, the trigger signal on the first electric branch is stopped, so that the current in the first electric branch is automatically cut off when the current in the first electric branch crosses zero point.

In the above process, the non-arc turn-off of the normal power supply A is realized.

Preferably, in step S4, after it is detected that no current passes through the first electric branch, the third thyristor SCR3 or the fourth thyristor SCR4 is triggered to be turned on according to the current direction. A dead zone time may be set between the successive turn-on processes of the first and the second thyristor branches, thus it may be avoided that short-circuit failure occurs when the normal power supply A and the emergency power supply B are connected together. After the mechanical switch reaches the second contact, the current flows through the mechanical switch that has a smaller impedance. In step S5, when it is detected that the mechanical switch reaches the second contact, the trigger signal for the second electric branch is stopped. The non-arc entry of the emergency power supply B is realized.

When a short-circuit failure occurs on the thyristor, the capacitor is effective, and because the equivalent impedance of the capacitor is large, the mechanical switch is not bypassed, either. Even if a failure occurs on the capacitor, because the capacitor becomes open after failure, the whole electric branch is also kept to open and no influence is laid on the load.

After switching, residual electricity may reside in the capacitor in the first electrical branch. If the residual electricity is not eliminated, an impact may be caused in the first electrical branch when switching back to the first electrical branch for the next time. Thus, step S3.1 is preferably added, in which a discharge bidirectional thyristor in the discharge circuit is triggered during a time interval between switching processes so as to discharge the capacitor for the next use. A similar processing may be employed on the second electric branch when switching back to the normal power supply A.

The above contents are detailed illustrations of the invention in conjunction with specific preferred embodiments of the present invention; however, the present invention is not limited thereto. Various modifications and variations may be made by those skilled in the art without departing from the scope of the invention, and all these modifications and variations are contemplated to be within the scope of the invention.

The invention claimed is:

1. An arc extinguishing switch, comprising a mechanical switch and a first electric branch connected in parallel with a first contact branch of the mechanical switch, wherein the first electric branch comprises a first controllable unidirectional turn-on subbranch and a second controllable unidirectional turn-on subbranch, the first controllable unidirectional turn-on subbranch and the second controllable unidirectional turn-on subbranch are respectively controlled by two thyristors to be turned on in AC positive and negative periods correspondingly and share a first capacitor connected in series with the two thyristors, wherein the arc extinguishing switch further comprises a first discharge circuit connected in parallel with the first capacitor.

2. The arc extinguishing switch according to claim 1, wherein, the first controllable unidirectional turn-on subbranch comprises a first thyristor, a second diode and the first capacitor, the second controllable unidirectional turn-on subbranch comprises a second thyristor, a first diode and the first capacitor, a cathode of the first thyristor and an anode of the first diode are connected to one end of the first contact branch, a cathode of the second thyristor and an anode of the second diode are connected to the other end of the first contact branch, the cathodes of the first diode and the second diode are connected to one end of the first capacitor, and the anodes of the first thyristor and the second thyristor are connected to the other end of the first capacitor.

3. The arc extinguishing switch according to claim 1, wherein, the first controllable unidirectional turn-on subbranch comprises a first thyristor, a second diode and the first capacitor, the second controllable unidirectional turn-on subbranch comprises a second thyristor, a first diode and the first capacitor, an anode of the first thyristor and a cathode of the first diode are connected to one end of the first contact branch, an anode of the second thyristor and a cathode of the second diode are connected to the other end of the first contact branch, the cathodes of the first thyristor and the second thyristor are connected to one end of the first capacitor, and the anodes of the first diode and the second diode are connected to the other end of the first capacitor.

4. The arc extinguishing switch according to claim 1, wherein, the first controllable unidirectional turn-on subbranch comprises a first thyristor, a second diode and the first capacitor, the second controllable unidirectional turn-on subbranch comprises a second thyristor, a first diode and the first capacitor, an anode of the first diode and a cathode of the second diode are connected to one end of the first contact branch, an anode of the first thyristor and a cathode of the second thyristor are connected to the other end of the first contact branch, cathodes of first diode and the first thyristor are connected to one end of the first capacitor, and anodes of the second diode and the second thyristor are connected to the other end of the first capacitor.

5. The arc extinguishing switch according to claim 1, further comprising: a second electric branch connected in parallel with a second contact branch of the mechanical switch, the second electric branch comprises a third controllable unidirectional turn-on subbranch and a fourth controllable unidirectional turn-on subbranch, the third controllable unidirectional turn-on subbranch and the fourth controllable unidirectional turn-on subbranch are respectively controlled by another two thyristors to be turned on in AC positive and negative periods correspondingly and share a second capacitor connected in series with the another two thyristors.

6. The arc extinguishing switch according to claim 5, further comprising a second discharge circuit connected in parallel with the second capacitor.

7. A switching method using an arc extinguishing switch claim 1, comprising:

a. issuing, by a system controller, a switching signal;

b. triggering a thyristor of a first controllable unidirectional turn-on subbranch or a thyristor of a second controllable unidirectional turn-on subbranch to be turned on according to a current direction;

c. making a mechanical switch depart from a first contact, and supplying power to a load by a current flowing through a first electric branch; and d. stopping triggering the thyristor of the first electric branch when detecting that the mechanical switch departs from the first contact and reaches a safe distance that is unable to cause an arc; and discharging a first capacitor shared by the first controllable unidirectional turn-on subbranch and the second controllable unidirectional turn-on subbranch.

8. The switching method according to claim 7, further comprising the following steps after step d:

e. after detecting that no current passes through the first electric branch, triggering a thyristor of a third controllable unidirectional turn-on subbranch or a thyristor of a fourth controllable unidirectional turn-on subbranch to be turned on according to the current direction, and supplying power to the load by a current flowing through a second electric branch; and f. stopping triggering the thyristor of the second electric branch after detecting that the mechanical switch reaches a second contact.

* * * * *

UNITED STATES PATENT AND TRADEMARK OFFICE

CERTIFICATE OF CORRECTION

PATENT NO. : 8,665,569 B2
APPLICATION NO. : 13/051641
DATED : March 4, 2014
INVENTOR(S) : Frank Heerdt et al.

It is certified that error appears in the above-identified patent and that said Letters Patent is hereby corrected as shown below:

In the Claims

Column 10, Claim 7, Line 5 After "switch", delete "claim 1"

Signed and Sealed this
Twenty-second Day of July, 2014

Michelle K. Lee

Michelle K. Lee
*Deputy Director of the United States Patent and Trademark Office*